United States Patent [19]

Isozumi et al.

[11] Patent Number: 5,032,736

[45] Date of Patent: Jul. 16, 1991

[54] COAXIAL TYPE STARTER DEVICE

[75] Inventors: Shuzoo Isozumi; Keiichi Konishi, both of Himeji, Japan

[73] Assignee: Mitsubishi Denki Kabushiki Kaisha, Tokyo, Japan

[21] Appl. No.: 424,048

[22] Filed: Oct. 19, 1989

[30] Foreign Application Priority Data

| | | | |
|---|---|---|---|
| Nov. 1, 1988 | [JP] | Japan | 63-277979 |
| Nov. 11, 1988 | [JP] | Japan | 63-147938[U] |
| Jan. 6, 1989 | [JP] | Japan | 1-1514 |

[51] Int. Cl.[5] ..... F02N 11/00

[52] U.S. Cl. ..... 290/48

[58] Field of Search ..... 290/48

*Primary Examiner*—A. D. Pellinen
*Assistant Examiner*—Robert L. Hoover
*Attorney, Agent, or Firm*—Sughrue, Mion, Zinn, Macpeak and Seas

[57] ABSTRACT

A coaxial type starter device comprises, in axial alignment, an armature rotary shaft for a motor, a rotary output shaft with a pinion at its front end which is supported so as to be slidable in its axial direction, and an electromagnetic switch device attached to the rear end of the motor. Two windows are formed in the end wall of a rear bracket attached to the rear end of the yoke of the motor; two stationary contacts at the power source side and the brush side are arranged at the rear end portion of the motor and project inside of the electromagnetic switch device through the windows; an exciting coil is disposed in the electromagnetic switch device; and a cup-shaped plunger is slidably arranged in the electromagnetic switch device. A rod is axially movable with the plunger and supports movable contacts to be brought into engagement with the stationary contacts, and a cylindrical body is formed at the end wall of the rear bracket to surround the movable contacts. The cylindrical body is extended such that its free end overlaps with a part of the inner circumferential surface when the plunger is at the fully retracted position.

10 Claims, 9 Drawing Sheets

COAXIAL TYPE STARTER DEVICE

BACKGROUND OF THE INVENTION

The present invention relates to a coaxial type starter device for starting an automobile engine.

There has been known a coaxial starter device of this kind as disclosed in, for instance, Japanese Unexamined Utility Model Publication 71474/1988 (Japanese Utility Model Application 166198/1986). The conventional coaxial type starter device disclosed in this publication comprises, as shown in FIG. 11, a d.c. motor 1 having a tubular armature rotary shaft 1*a*. A rotary output shaft 4 which is arranged at one side in the axial direction of the d.c. motor 1, is adapted to receive a force of revolution from the armature rotary shaft 1*a* through a driving force transmitting device 3 including a planet gear speed reducing means 2, and is slidable in its axial direction. A pinion 5 is arranged at the front end portion of the rotary output shaft 4, and an electromagnetic switch 6 is arranged at the other side in the axial direction of the d.c. motor, which is adapted to supply a current to the d.c. motor and to push the rotary output shaft to cause the sliding movement. The armature rotary shaft 1*a* of the d.c. motor 1 is arranged in the same axial line as the electromagnetic switch 6.

In the coaxial type starter device having the construction described above, the rear bracket 7 of the d.c. motor 1 is provided with an opening formed in its end plane, and a power source side stationary contact 8*a* and a brush side stationary contact 8*b* project into the electromagnetic switch device 6 through the opening. On the other hand, the electromagnetic switch device 6 has a cup cylinder-shaped plunger 10 which is arranged in an exciting coil 9 so as to be slidable in its axial direction, and an end of a rod 11 arranged on the axial line of the plunger 10 is fixed to the plunger 10. The other end of the rod 11 extends in the armature rotary shaft 1*a* of the d.c. motor 1 through the central opening of the rear bracket 7 so that it can push the rotary output shaft 4. A pair of movable contacts 12 are supported by the rod 11 in the electromagnetic switch 6. The movable contacts 12 can be moved by the movement of the rod 11 in the axial direction by the movement of the plunger 10 so that the movable contacts 12 are brought into engagement with the stationary contacts 8*a*, 8*b* projected through the opening formed in the end plane of the rear bracket 7 so as to form a short circuit between the stationary contacts.

In the conventional coaxial type starter device, however, powder resulting from the wearing of brushes in the d.c. motor 1 may enter in the electromagnetic switch device 6 through the opening formed in the end plane of the rear bracket, or powder caused by the engagement between the movable contacts 12 and the stationary contacts 8*a*, 8*b* or resulting from the vibrations of an insulating material interposed between the movable contacts 12 and the rod 11 may fall and deposit on the inner surface, i.e., the sliding surface of a sleeve 13 fitted to the inner circumferential portion of the exciting coil 9. When such powder deposits accumulate on the sliding surface, there is a danger that the plunger can not smoothly slide. When this happens the movable and stationary contacts cannot engage, and the d.c. motor 1 becomes inoperable.

SUMMARY OF THE INVENTION

It is an object of the present invention to provide a starter device which eliminates a danger of faulty sliding operation of the plunger of the electromagnetic switch due to the deposit of powder resulting from the wearing of the contacts and vibrations of the insulating material.

In accordance with the present invention, a coaxial type starter device comprises an armature rotary shaft for a motor, a rotary output shaft with a pinion at its front end which is supported so as to be slidable in its axial direction, and an electromagnetic switch device attached to the rear end of the motor, all being arranged in the same axial line, characterized by two windows formed in the end wall of a rear bracket attached to the rear end of the yoke of the motor, a stationary contact at the power source side and a stationary contact at the brush side which are respectively arranged at the rear end portion of the motor and are projected to the inside of the electromagnetic switch device through the windows formed in the end wall of the rear bracket, an exciting coil in the electromagnetic switch device, a cup-shaped plunger arranged in the electromagnetic switch device so as to be slidable in its axial direction, a rod which is operable in association with the plunger so as to extend along its axial line and supports movable contacts which are brought into contact with the stationary contacts, and a cylindrical body formed at the end wall of the rear bracket to surround the movable contacts, the cylindrical body being extended to the extent that its free end overlaps with a part of the inner circumferential surface of said plunger when the plunger is at the fully retracted position.

In accordance with the present invention, there is provided a coaxial type starter device wherein a switching contact for actuating a motor is arranged in a space which allows the movement of a plunger in an electromagnetic switch device, characterized in that either the outer circumferential portion of the plunger or the inner circumferential portion of a sleeve to which the plunger fits is provided with a number of grooves extending in its axial direction.

In accordance with the present invention, there is provided a coaxial type starter device comprising an armature rotary shaft for a motor, a rotary output shaft with a pinion at its front end which is supported so as to be slidable in its axial direction, and an electromagnetic switch device attached to the rear end of the motor, all being arranged in the same axial line, characterized by a housing disposed between the motor and the electromagnetic switch device so as to support the armature rotary shaft and having insertion holes for receiving brush holding parts, and a brush holder fitted to the housing on the side of the electromagnetic switch device so as to close an opening formed in the housing, the brush holder being provided with the brush holding parts on the side of the motor and stationary contacts on the side of the electromagnetic switch device so that they come to contact with movable contacts disposed in the electromagnetic switch device.

DETAILED DESCRIPTION OF THE PREFERRED EMBODIMENTS

Preferred embodiments of the coaxial type starter device of the present invention will be described with reference to the drawings.

Figure 1:
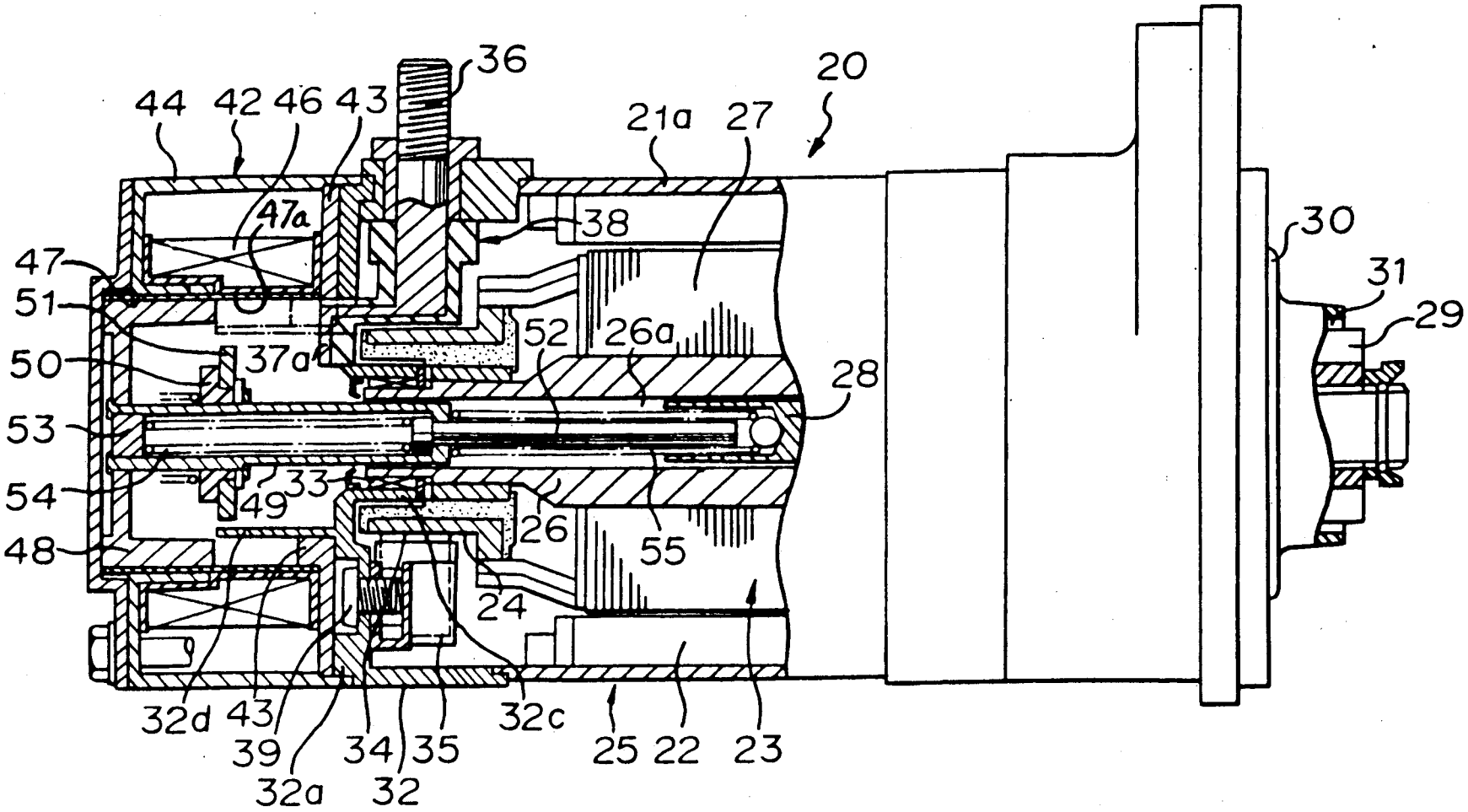
FIG. 1 is a side view partly cross-sectioned of an embodiment of the coaxial type starter device according to the present invention.

FIG. 1 shows an embodiment of the coaxial type starter device 20 of the present invention, and is a double or angled section about the central axis of the device to maximize the illustration of the various components. The coaxial type starter device 20 has a d.c. motor 25 which comprises permanent magnets 22 attached to the inner circumferential surface of the yoke 21*a* constituting an outer wall to form a magnetic circuit with intervals in the circumferential direction, an armature 23 arranged at the center of the yoke 21*a* in a freely rotatable manner and a commutator 24 of a conventional type which is disposed at a side of the armature 23.

The armature 23 of the d.c. motor 25 comprises a tubular armature rotary shaft 26 and cores 27 attached to the outer circumference of the rotary shaft 26. A rotary output shaft 28 is arranged at a side in the axial direction, i.e. in front of (at the right side in FIG. 1) of the d.c. motor 25 so that a force of revolution is transmitted to the rotary output shaft by a driving force transmitting device (not shown). The rotary output shaft 28 is arranged in the same axial line as the armature rotary shaft 26 of the d.c. motor 25 and has an end inserted in the axial bore 26*a* of the armature rotary shaft 26 so that the rotary output shaft is slidable in the axial direction through sleeve bearings (not shown) interposed between the outer circumference of the shaft 28 and the inner circumference of the armature rotary shaft 26.

A pinion 29 is attached to the front end of the rotary output shaft 28. The pinion 29 projects through a front opening 31 formed in a front machine frame 30 in which the driving force transmitting device received. The sliding movement of the rotary output shaft 28 engages the pinion with a ring gear (not shown) of the engine.

A cup-shaped rear bracket 32 made of aluminum or a non-magnetic material is fitted to the rear end portion of the yoke of the d.c. motor, and an electromagnetic switch 42 is fitted to the rear bracket 32. An opening 32*b* (FIG. 2) is formed at the central portion of the end wall 32*a* of the rear bracket 32 attached to the rear end portion of the d.c. motor 25. The opening 32*b* is defined by a cylindrical flange portion 32*c* projecting inwardly towards the d.c. motor. A bearing 33 is fitted to the inner circumference of the opening 32*b* so as to support the rear end portion of the armature rotary shaft 26.

Figure 2:
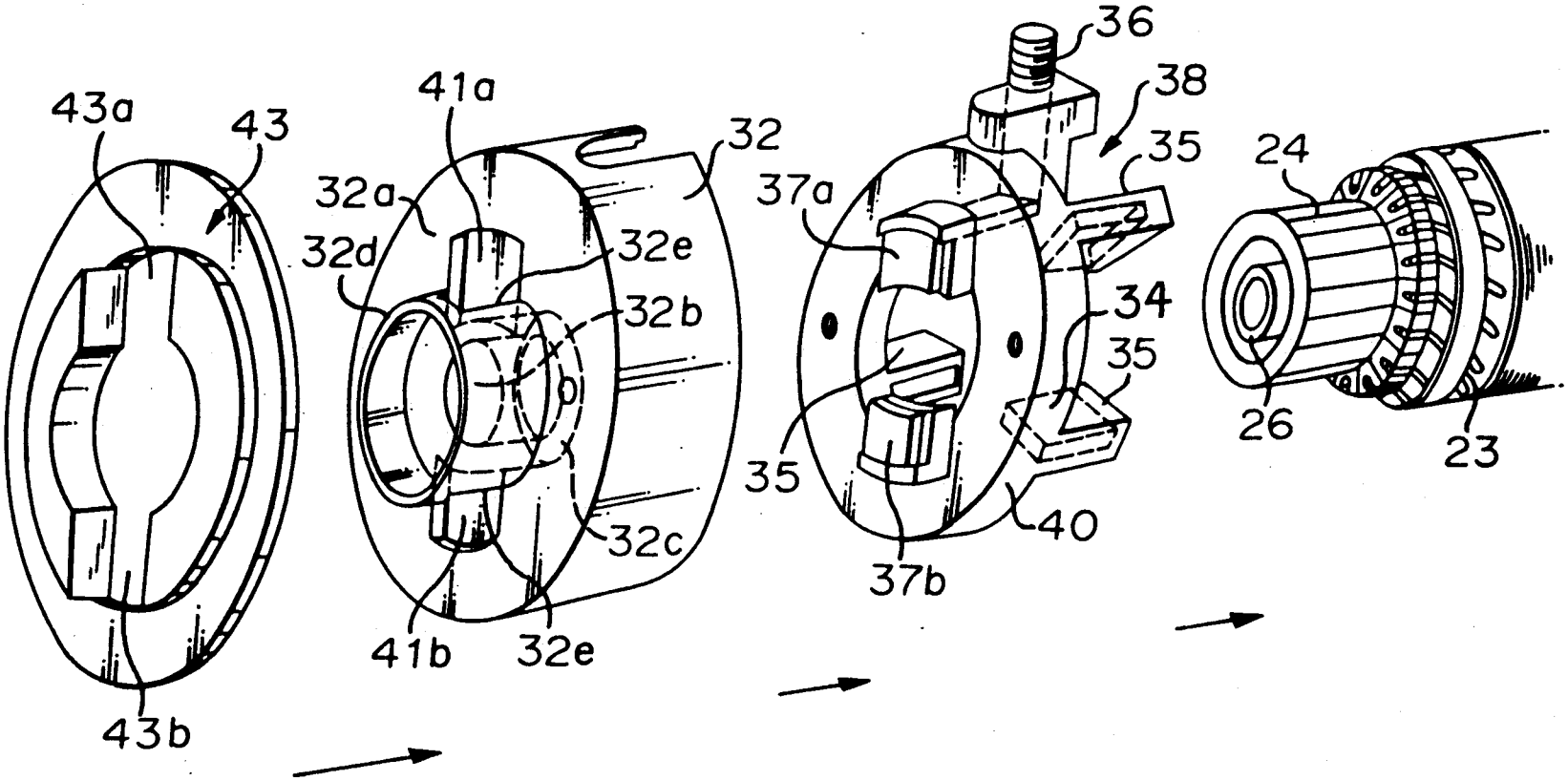
FIG. 2 is a perspective view in a disassembled state of an embodiment of the coaxial type starter device as shown in FIG. 1.

As shown in FIG. 2, a brush supporting terminal assembly (hereinbelow, referred to as a brush holder) is disposed inside the rear bracket 32 and is secured to it by means of screws 39 (FIG. 1). The brush holder 38 comprises brush holding parts 35 for holding a plurality of brushes 34 which slidably contact the commutator 24, a bolt 36 for an external terminal which is connected to a power source such as a battery, a stationary contact 37*a* at the power source side electrically connected to the bolt 36, and a stationary contact 37*b* at the brush side electrically connected to the brushes 34, the above-mentioned elements being held together as a unit by a resinous material.

The brush holder 38 has as shown in FIG. 2 a ring body 40 made of a resinous material wherein the brush holding parts 35 are formed at a side surface and the stationary contacts 37*a*, 37*b* project from the other surface in the axial direction so as to meet movable contacts of the electromagnetic switch device. By attaching the brush holder 38 to the inner surface of the rear bracket 32 by the screws 39, the end wall 32*a* of the rear bracket is brought into close contact with the outer surface of the ring body 40 of the brush holder 39. In this case, openings, i.e. windows 41*a*, 41*b* are respectively formed in the rear bracket at positions corresponding to the stationary contacts 37*a*, 37*b* so as to permit the stationary contacts 37*a*, 37*b* to project through the rear side of the end wall 32*a* of the rear bracket 32, namely, toward the electromagnetic switch device 42. A cylindrical body 32*d* coaxial with the opening 32*b* is formed at the outer surface of the end wall 32*a* of the rear bracket 32. The cylindrical body 32*d* may be formed integrally with the rear bracket 32 in this embodiment. However, it may be separately formed from the rear bracket and may be fixed to the end wall 32*a*. As shown in FIG. 2, cut portions or openings 32*e* are formed in the circumferential wall of the cylindrical body 32*d* at positions corresponding to the windows 41*a*, 41*b* so that the stationary contacts 37*a*, 37*b*projecting through the windows 41*a*, 41*b* toward the electromagnetic switch device do not interfere with the cylindrical body 32*d*. The length in the axial direction and the size (diameter) of the cylindrical body 32*d* are important factors in the present invention, and since they are closely related to the construction of the electromagnetic switch device 42, they will be described in more detail below.

A numeral 43 designates a front core a structural element of the electromagnetic switch device 42. The front core 43 is attached closely to the outer surface of the end wall 32*a* of the rear bracket 32. Cut portions, 43*a*, 43*b* are respectively formed in the front core 43 to enable the stationary contacts 37*a*, 37*b* to pass through the windows 41*a*, 41*b* formed in the end wall 32*a* of the rear bracket 32, to thereby allows them to further project toward the electromagnetic switch 42.

The electromagnetic switch device 42 comprises an exciting coil 46 wound on a bobbin of a plastic material supported by the front core 43 and a cylindrically flanged rear core of a casing 44 which forms magnetic path, a cup-shaped plunger 48 which is fitted to the central opening of the bobbin and is arranged in a sleeve 47 in a slidable manner, a rod 49 of a tubular form which is made of a non-magnetic material such as stainless steel which has one end connected to the plunger 48 and the other end inserted in the axial bore 26*a* from the rear end of the armature rotary shaft 26 through the opening 32*b* formed in the end wall 32*a* of the rear bracket 32, and movable contacts 51 supported, by the rod 49 through an insulating material 50. A push rod 52 is inserted inside the tubular rod 49 in a slidable manner. The push rod 52 extends forwardly from the front opening of the tubular rod 49, and the front end of the push rod faces a steel ball disposed in a recess formed in end of the rotary output shaft 28 with a small gap.

The rear end of the tubular rod 49 is closed. A coil spring 54 is arranged inside the push rod 49 between a closed ,portion 53 of the rod and the rear end of the push rod 52. The coil spring 54 functions to give a push force to the push rod 52, and hence the rotary output shaft 28 when the tubular rod 49 is moved. A numeral 55 designates a coil spring to keep the steel ball at a predetermined position. The coil spring 55 also functions to return the tubular rod 49.

The inner diameter of the cylindrical body 32*d* formed at the outer surface of the end wall 32*a* of the rear bracket 32 has a sufficient dimension to allow the movable contacts 51 to come in and go out and the outer diameter is smaller than the inner diameter of the plunger 48, as illustrated in FIG 1. The length of the cylindrical body in its axial direction is so determined that the rear portion of the cylindrical body is slightly overlapped with the inner circumference of the plunger 48 when the plunger 48 is at its stand-still position, i.e. a retracted position.

The operation of the coaxial type starter device 20 of the embodiment described above will be explained.

When the starter switch of the automobile is closed, the electromagnetic device 42 is actuated to move the plunger 48 forwardly. Then, the tubular rod 49 is moved so that the coil spring 54 in the tubular rod 49 is compressed at the push rod 52 is pushed, whereby the rotary output shaft 28 is slidably moved in the forward direction. The pinion 29 is interlocked with the ring gear of the engine and the movable contacts 51 attached to the tubular rod 49 are brought into engagement with the stationary contacts 37*a*, 37*b* so that a power source is connected to the d.c. motor 25. As a result, the force of revolution of the armature rotary shaft 26 of the d.c. motor 25 is transmitted to the rotary output shaft 28 through the driving force transmitting device comprising a planet gear speed reducing device and a one-way clutch device so that the engine is driven by the rotation of the pinion 29.

On starting the engine, current supply to the electromagnetic switch device 42 is cut, and the rotary output shaft 28 is returned to its original position by means of a return spring interposed in an appropriate portion, whereby the engagement between the pinion and the ring gear of the engine is released. In the above-mentioned operations, the cylindrical body 32*d* provided on the rear bracket 32 always covers or overlies the sliding surface 47*a* of the sleeve 47 when the plunger 48 is at the standstill position, i.e. the retracted position, whereby powder resulting from the wearing of the brushes is prevented resulting from depositing on the sliding surface 47*a* even though it enters in the electromagnetic switch device 42 through the central opening 32*b* of the rear bracket 32. If it enters, it deposits on the cylindrical body 32*d* or accumulates on the inner surface of the plunger 48 after it has passed through the cylindrical body 32*d*. The movable contacts 51 can contact with the stationary contacts 37*a*,37*b* inside the cylindrical body 32*d*. Accordingly, powder resulting from the mutual contact of the movable and stationary contacts or powder resulting from the wearing of the insulating material due to vibrations either accumulate on the inner surface of the cylindrical body 32*d* or on the inner surface of the plunger 48.

Thus, in the above-mentioned embodiment, powder from the brushes, the contacts or the insulating material is prevented from depositing on the sliding surface of the plunger. Accordingly, there is no danger that a fault in the sliding movement of the plunger takes place, and there is no danger that a fault in the mutual contact between the movable and stationary contacts takes place, whereby the operation of the motor can be assured for a long time.

Figure 3:
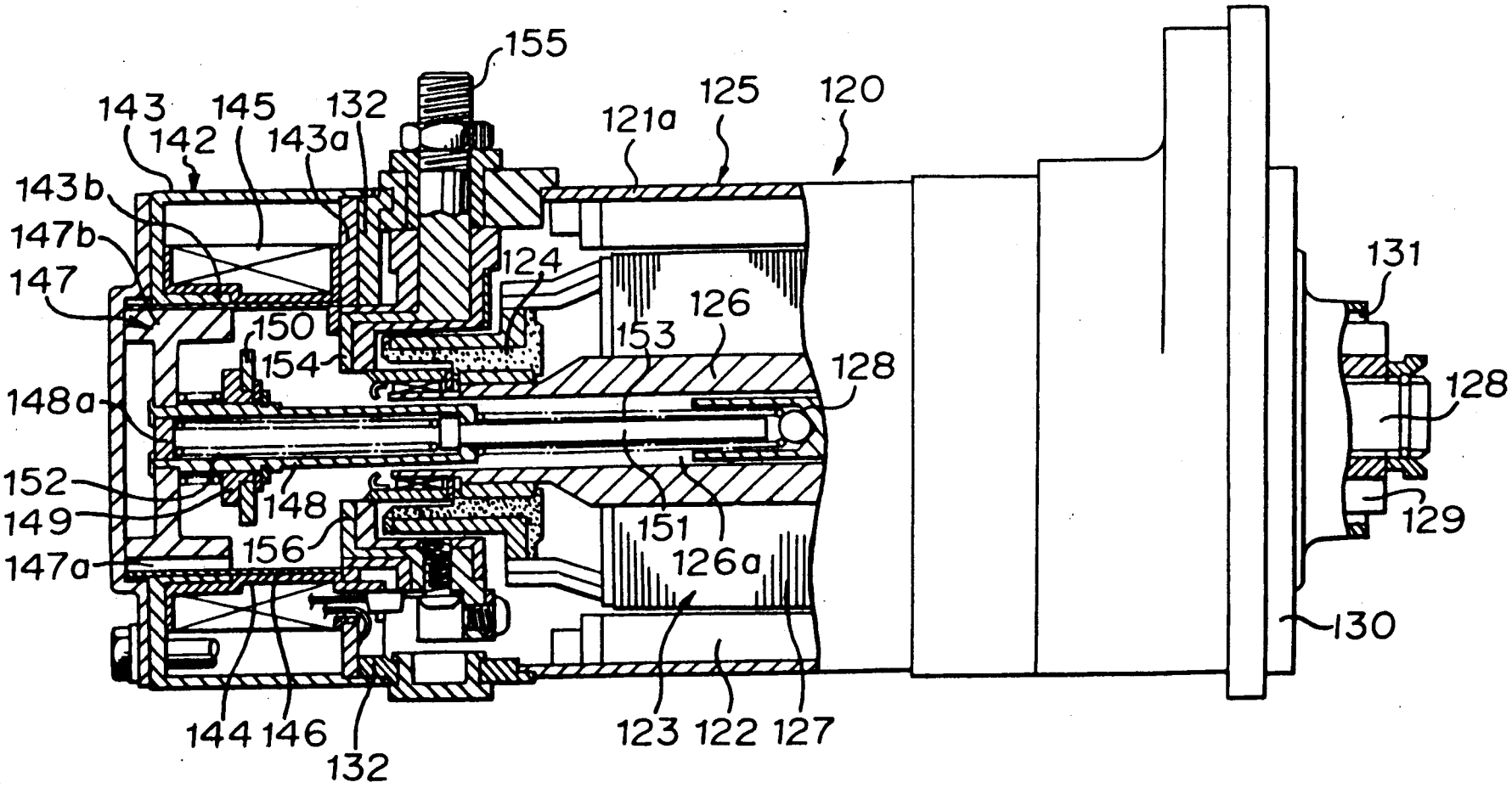
FIG. 3 is a side view partly cross-sectioned of another embodiment of the coaxial type starter device according to the present invention.

FIG. 3 shows another embodiment of a coaxial type starter device 120 according to the present invention. The coaxial type starter device has a d.c. motor 125 which comprises permanent magnets 122 attached to the inner circumferential surface of the yoke 121*a* as a part of elements constituting a magnetic circuit and an outer wall with predetermined intervals in the circumferential direction, an armature 123 disposed at the central portion of the yoke 121*a* so as to be rotatable, and a commutator 124 of a conventional type which is arranged at one end of the armature 123.

The armature 123 of the d.c. motor 125 comprises a tubular armature rotary shaft 126 and an armature core 127 attached to the outer circumference of the rotary shaft 126. A rotary output shaft 128 is arranged at one end in the axial direction of the d.c. motor 125, i.e. at the front end (at the right side in FIG. 3) of it so that a force of revolution force is transmitted through a driving force transmitting device (not shown). The rotary output shaft 128 is disposed on the same axial line as the armature rotary shaft 126 of the d.c. motor 125. An end portion of the rotary output shaft 128 is inserted in an axial bore 126*a* formed in the armature rotary shaft 126 and is supported to be slidable in the axial direction by means of a sleeve bearing (not shown) interposed between the outer circumference of the rotary output shaft 128 and the inner circumference of the armature rotary shaft 126. A pinion 129 is attached to the front end portion of the rotary output shaft 128 in such a manner that it projects through an front opening 131 formed in a front machine frame 130 receiving therein the driving force transmitting device by the sliding movement of the rotary output shaft 128 to thereby interlock with a ring gear (not shown) of the engine.

A cup-shaped rear bracket 132 made of aluminum or a non-magnetic material is fitted to the rear end portion of the yoke of the d.c. motor 125, and an electromagnetic switch device 142 is attached to the rear surface of the rear bracket 132 with respect to the motor. The electromagnetic switch device 142 comprises an exciting coil 145 wound on a bobbin 144 made of a plastic material supported by front and rear cores 143*a*, 143*b* which form a magnetic path in association with a casing 143, cup-shaped plunger 147 which is disposed in a sleeve 146 fitted to a central opening of the bobbin in a slidable manner, a rod 148 in a tubular form made of a non-magnetic material such as stainless steel which has one end connected to the plunger 147 and the other end inserted in the axial bore 126*a* from the rear end portion of the armature rotary shaft 126 through an opening formed in an end wall 132*a* of the rear bracket 132, and movable contacts 150 supported by the tubular rod 148 through an insulating material 149. A push rod 151 is inserted inside the tubular rod 148 so as to be slidable. The push rod 151 extends forwardly from the front opening of the tubular rod 148 and its front end faces a steel ball disposed in a recess formed at the end of the rotary output shaft 128 with a small gap.

The rear end of the tubular rod 148 is closed. A coil spring 152 is placed inside the rod 148 and between a closed, portion 148*a* of the rod 148 and an end of the push rod 151. The coil spring 152 imparts a pushing force to the rod 151, and hence the rotary output shaft 128 when the tubular rod 148 is moved. A reference numeral 153 designates a coil spring to keep the steel ball at a predetermined position. A numeral 154 designates a stationary contact at the power source side which is formed integrally with a terminal bolt 155 and which projects toward the sleeve 146 in which the plunger 147 of the electromagnetic switch device 142 moves, and a numeral 156 designates a stationary contact at the brush side which is attached to the rear bracket 132 to be electrically connected to the brushes of the d.c. motor 125 by an appropriate means and projects toward the sleeve 146.

Figure 4:
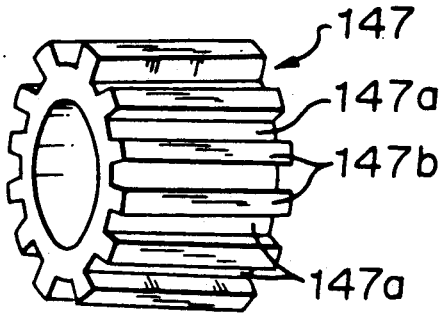
FIG. 4 is a perspective view of an embodiment of the plunger of an electromagnetic switch device used for the starter device shown in FIG. 3.

The plunger 147 in the electromagnetic switch device 142 of this embodiment is provided with a number of grooves 147*a* having a rectangular shape in cross-section which are spaced apart from each other at equal distances in the outer circumferential direction and extend in the axial direction of the plunger as shown in FIG. 4. In such plunger 147, the outer surface of each projection 147*b* formed between the adjacent grooves 147*a* constitutes a surface which is in direct sliding contact with the inner circumferential surface of the sleeve 146. Thus, by forming the number of grooves in the plunger 147 in its axial direction, namely, by forming projections 147*b* extending in the moving direction of the plunger 147, powder resulting from the wearing of the movable and stationary contacts and falling on the inner circumference of the sleeve 146 is scraped and collected by the projections 147*b* formed at the plunger 147, whereby the powder is gathered in the grooves 147*a*. Thus, there is no accumulation of the powder resulting from the wearing of the contacts and so on on the slide-contacting surface of the projections which are in direct-contact with the inner circumferential surface of the sleeve 146. As a result, a disadvantage such as a fault of the sliding movement of the plunger can be eliminated.

Figure 5:
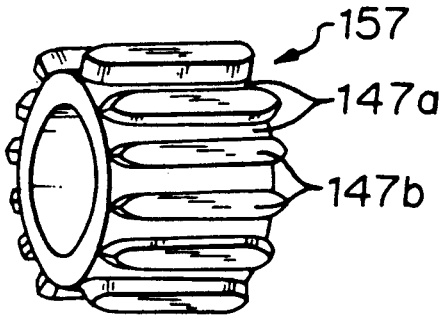
FIG. 5 is a perspective view of another embodiment of the plunger.

Instead of using the plunger 147 provided with the projections 147*b* each having a rectangular shape in cross-section and formed at the outer circumference of the plunger 147 and between the adjacent grooves 147*a*, a plunger 157 as shown in FIG. 5 wherein both ends of each of the projections 147*b* having a rectangular shape in cross-section are processed to be in a V-shape or a bow-like form, may be used. Thus, by forming the both ends of the projections 147*b* as shown in FIG. 5, the scraping and collection of the powder resulting from the wearing of the contacts can be further improved.

Figure 6:
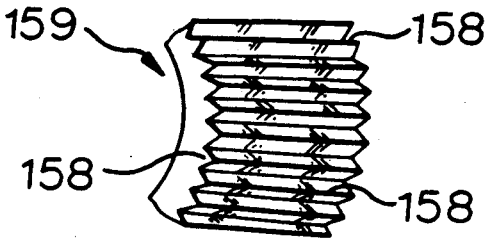
FIG. 6 is a perspective view partly broken of a still another embodiment of the plunger.

Further, a plunger 159 as shown in FIG. 6 wherein a number of projections 158 having a triangular shape in cross-section are formed at the outer circumferential portion of the plunger 159 so that the ridge of each projection is in line-contact with the inner circumferential surface of the sleeve 146, may be used instead of the plunger as shown in FIG. 4 or 5.

The grooves formed in the plunger may be formed at the inner circumferential portion of the sleeve 146, or such grooves may be formed in both the plunger 147 and the sleeve 146. In the later case, it is necessary that a pitch of the grooves to be formed in the plunger 147 is different from that of the grooves to be formed in the inner circumferential portion of the sleeve 146, or the width of the grooves is different from the width of the projections.

Thus, in accordance with the starter device of the second embodiment of the present invention, powder resulting from the wearing of the movable and stationary contacts or the brushes can be collected in the grooves formed in the plunger even though the powder falls on the sliding surface of the plunger. Accordingly, a fault in the sliding movement of the plunger is avoidable, and the movable contacts can be correctly brought to contact with the stationary contacts.

Figure 7:
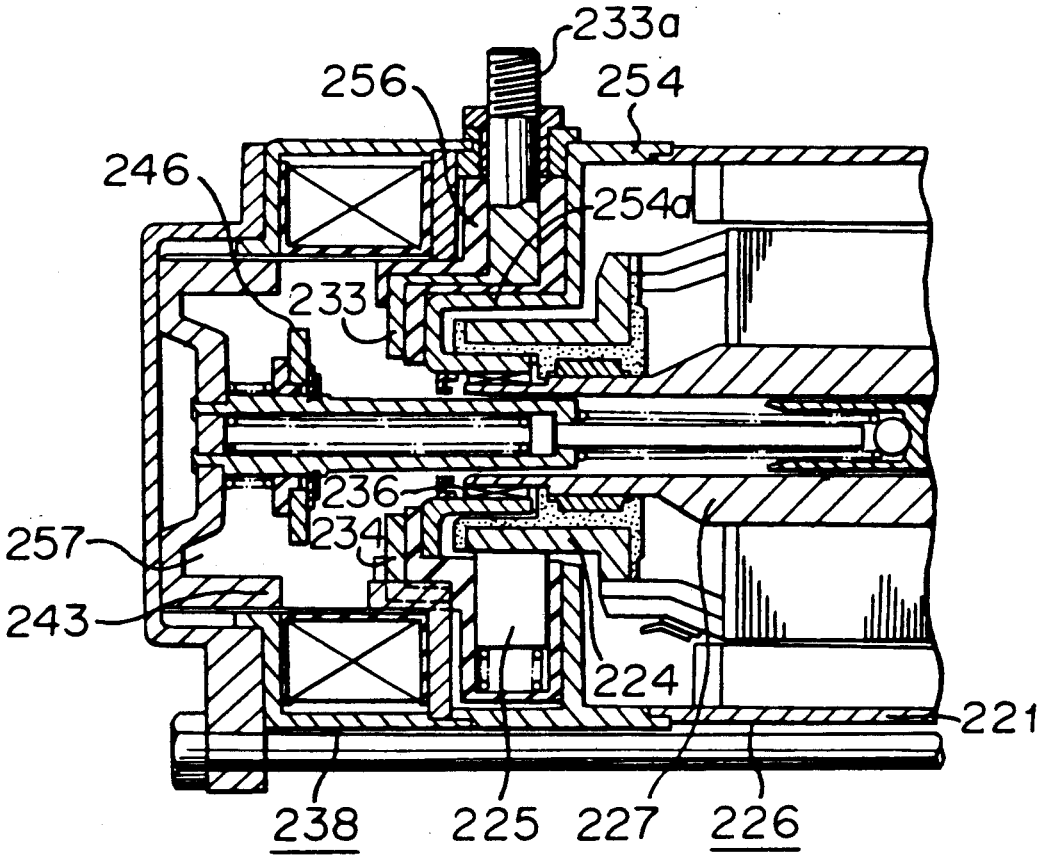
FIG. 7 is a cross-sectional view partly broken of another embodiment of the coaxial type starter device according to the present invention.
Figure 8:
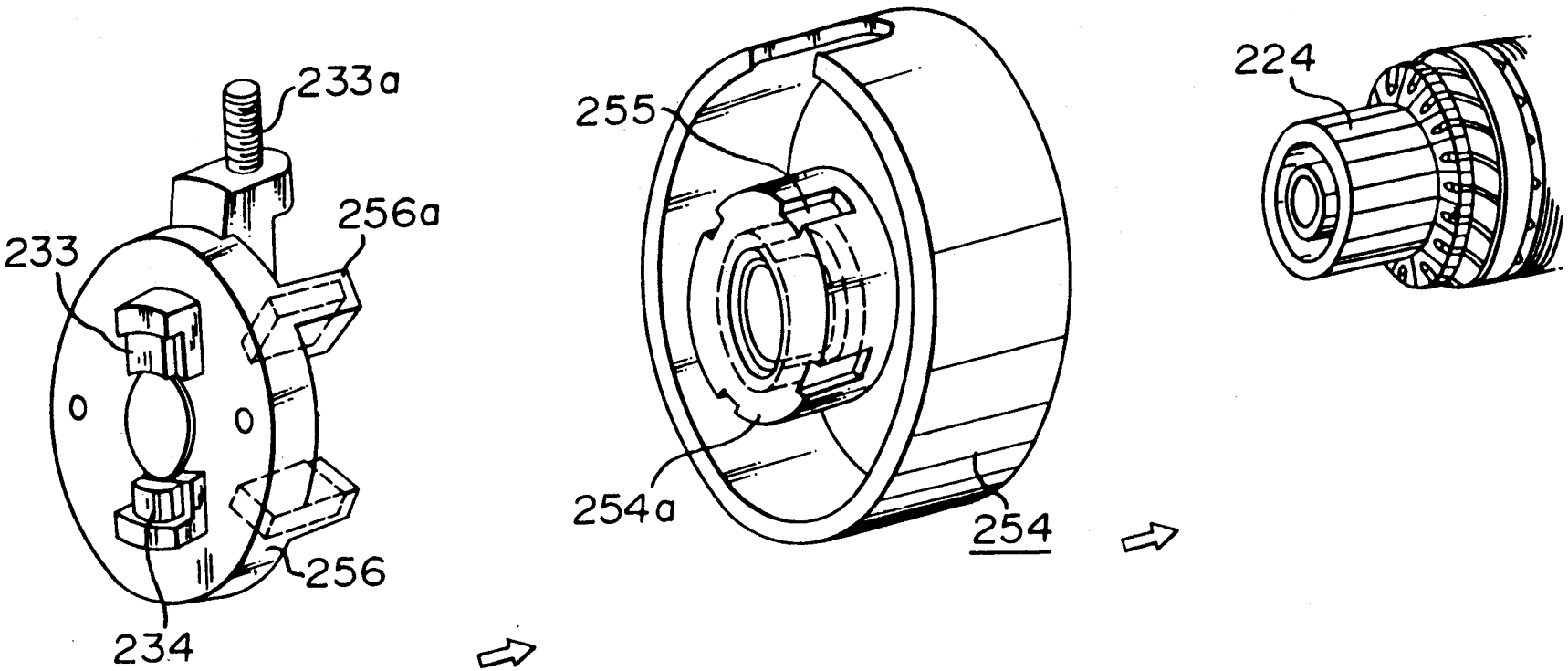
FIG. 8 is a perspective view in a disassembled state of an embodiment of the brush unit used for the coaxial type starter device of the present invention.

FIGS. 7 and 8 show another embodiment of the coaxial type starter device of the present invention. In FIGS. 7 and 8, a housing 254 is attached to the rear end of a yoke 221 and has a boss-like projection 254*a* projecting toward an electromagnetic switch device 238 so as to cover a commutator 224. Insertion holes 255 are formed at the circumferential portion of the projection 254*a* so that the brush holding parts of the brush holder are fitted thereto. A bearing 236 is fitted to the inner circumferential portion of the projection 254*a* so as to support the rear end portion of an armature rotary shaft 227. The brush holder 256 is made of a resinous material and is located at the rear side of the housing 254 (at the side of the electromagnetic switch 238), and the brush holder 256 includes stationary contacts 233, 234, a screw portion 233*a* for an external terminal, and a plurality of brush holding parts 256*a* which are formed by one-piece molding. A reference numeral 257 designates a contact chamber in the electromagnetic switch device 238, which is defined by a plunger 243, the sliding surface of the plunger 243 and the rear end surface of the brush holder 256, and a numeral 246 designates movable contacts. The brush assembly of the coaxial type starter device having the construction as above-mentioned is assembled in such a manner that the housing 254 is fitted to the motor so that the projection 254*a* covers the commutator 224 and the brush holder 256 is attached to the housing 254 so that the brush holding parts 256*a* are respectively inserted in the insertion holds 255 of the housing 254 as shown by arrow marks in FIG. 8.

Accordingly, a space including the brush holding parts 256*a* to be inserted in the insertion holes 255 is entirely closed by the brush holder 256 and the housing 254. As a result, the space in which there is sliding contact between the brushes 225 and the commutator 224, namely, the inner space of the d.c. motor 226, is shielded by the housing 254 and the brush holder 256, whereby the powder, resulting from the wearing of the brushes is prevented from entering into the contact chamber 257 of the electromagnetic switch device 238.

Engine starting operations of the above-mentioned coaxial type starter device is the same as those described in the embodiments mentioned before, and therefore description of the operations is omitted.

Figure 9:
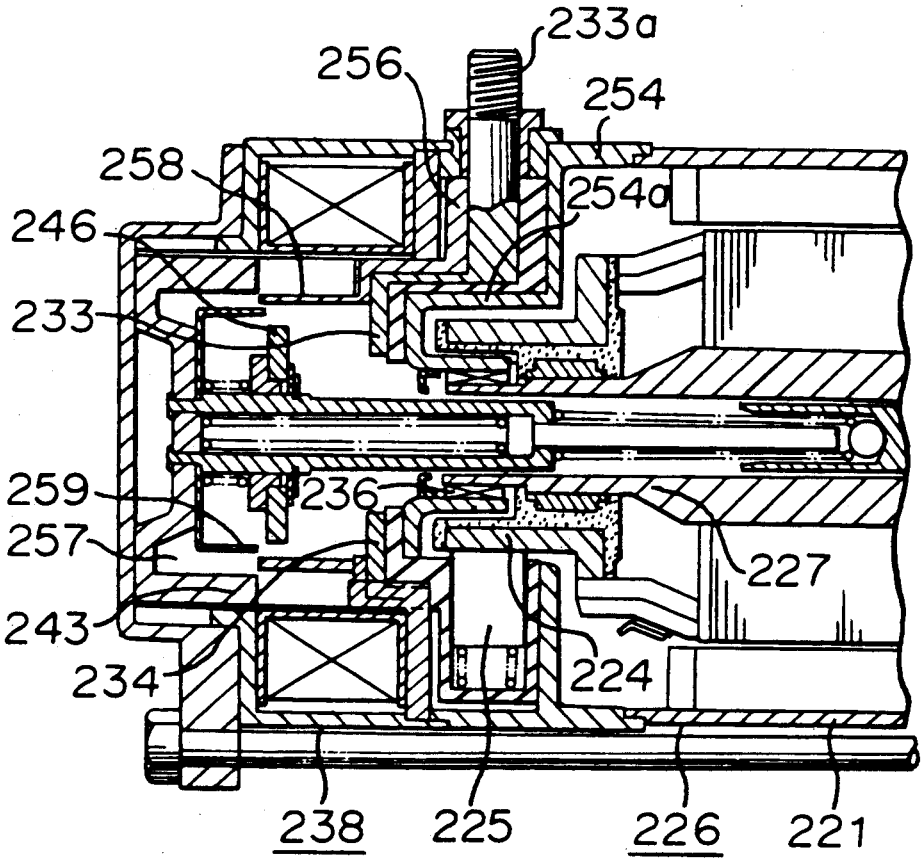
FIG. 9 is a cross-sectional view partly broken of another embodiment of the coaxial type starter device of the present invention.
Figure 10:
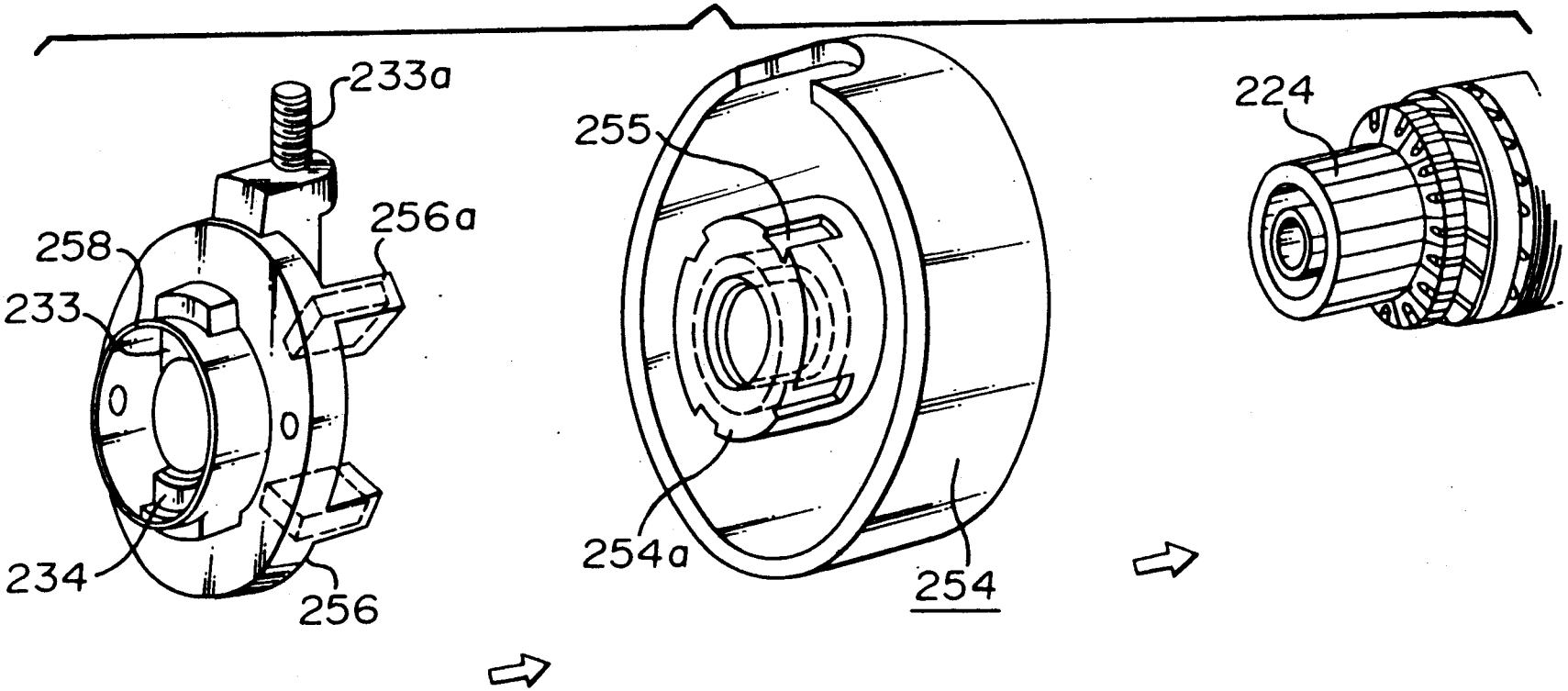
FIG. 10 is a perspective view in a disassembled state of the brush unit of the coaxial type starter device.
Figure 11:
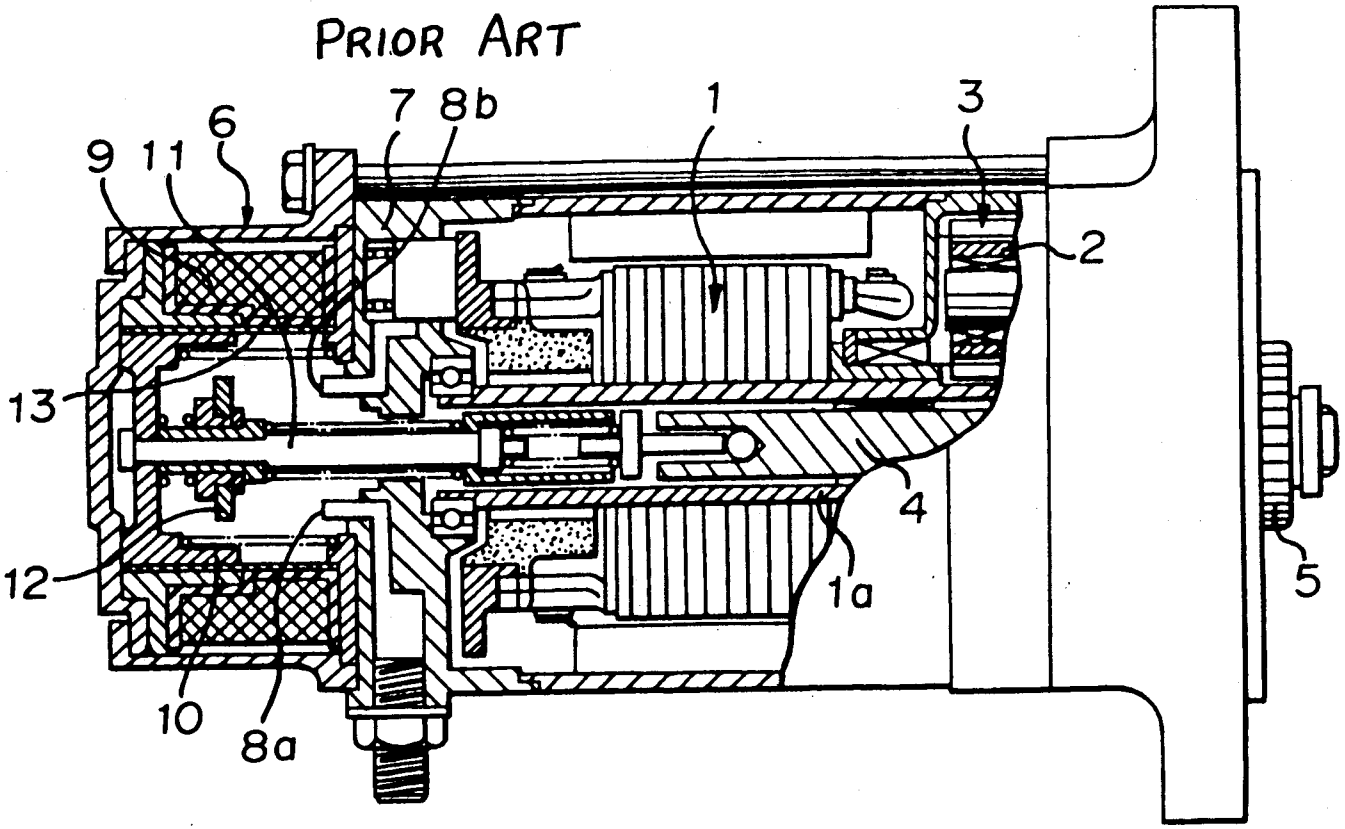
FIGURE 11 PRIOR ART
FIG. 11 is a side view partly cross-sectioned of a conventional coaxial, type starter device.

FIGS. 9 and 10 show another embodiment of the coaxial type starter device in which a cylindrical body 258 is provided so as to cover the slide-contacting surface of the plunger 243 from the rear end portion of the brush holder 256. Namely, the cylindrical body extending backwardly from the rear end plane of the brush holder 256 is formed integrally with it. The position of the rear end of the cylindrical body 258 is substantially flush with the front end of the outer circumferential wall of the plunger 243 and the circumferential edge portion of the cylindrical body comes close to the inner diameter portion of the plunger 243. A reference numeral 259 designates a cup-shaped cover which is immovably attached to the plunger 243 and has a diameter slightly smaller than the diameter of the cylindrical body 258. The front end of the cover 259 is extended so as to form a slight overlapping portion to the rear end of the cylindrical body 258 whereby a labyrinth structure is formed between the space on the side of the movable contacts, 246 of the contact chamber 257 and the space on the sliding contact surface of the plunger 243 by the cover 259, the cylindrical body 258 and the plunger 243.

The coaxial type starter device having the above-mentioned construction can prevent invasion of the powder resulting from the wearing of the brushes into the contact chamber 257 of the electromagnetic switch device 238 and can prevent adhesion of the powder resulting from the wearing of the mutual contact of the movable contacts 246 and the stationary contacts 233, 234 and the powder resulting from vibrations of the insulating material 245 for supporting the movable contacts 246 since the slide-contacting surface of the plunger 243 is covered by the cylindrical body 258. In particular, when the movable contacts 246 are moved relative to the plunger 243 at the time of engaging to and separating from the stationary contacts 233, 234, both contacts are surrounded by the cover 259 and the cylindrical body 258. Further, the cover 259, the cylindrical body 258 and the plunger 243 are brought to an overlapping state in their axial direction. Accordingly, there is no danger that the powder resulting from the wearing of the contacts enters into the slide-contacting surface of the plunger 243 to thereby prevent adhesion of the powder on the sliding surface of the plunger 243. Thus, a fault of sliding movement can be prevented.

In the above-mentioned embodiment, the rear end of the cylindrical body 258 is substantially flush with the front end of the outer circumferential wall of the plunger 243 in their axial directions. However, the length in their axial direction of the cylindrical body and the plunger, can be elongated as far as there is no impediment to the operational movement of the plunger 243.

In the above-mentioned embodiment, the cylindrical body 258 is formed integrally with the brush holder 256. However, the cylindrical body 258 may be prepared separately from the brush holder 256 and be attached to it. The cover 259 may be omitted and only cylindrical body 258 may be used, although it is preferable to use the cover 259 to prevent adhesion of the powder of contacts and the brushes on the sliding surface of the plunger 243. Further, a suitable number of reinforcing ribs may be provided between the projection 254*a* of the housing 254 and the outer circumferential wall of the housing to improve the strength of the housing 254.

Thus, in accordance with the above-mentioned embodiment of the present invention, it is possible to prevent the invasion of the powder of brushes and so on into the contact chamber of the electromagnetic switch device whereby faulty sliding movement of the plunger and faulty contacting movement of the contacts can be eliminated. Further, it is unnecessary to form a large opening in the housing. Accordingly, the strength of the housing can be improved and the weight of the housing can be reduced, whereby reduction of manufacturing cost is achievable.

In the embodiment as shown in FIGS. 9 and 10 in particular, the plunger and the cylindrical body surround the operating space for the movable contacts, whereby adhesion of the powder resulted from the wearing of the contacts on the sliding surface of the plunger can be prevented.

We claim:

1. A coaxial type starter device comprising an armature rotary shaft for a motor, a rotary output shaft with a pinion at its front end which is supported so as to be slidable in its axial direction, and an electromagnetic switch device attached to the rear end of said motor, all being arranged in the same axial line, characterized by two windows formed in the end wall of a rear bracket attached to the rear end of the yoke of said motor, a stationary contact at the power source side and a stationary contact at the brush side which are respectively arranged at the rear end portion of said motor and project inside of said electromagnetic switch device through said windows formed in the end wall of the rear bracket, an exciting coil in said electromagnetic switch device, a cup-shaped plunger arranged in said electromagnetic switch device so as to be slidable in its axial direction, a rod which is operable in association with said plunger so as to extend along its axial line and supports movable contacts which are brought into contact with said stationary contacts, and a cylindrical body formed at the end wall of said rear bracket to surround said movable contacts, said cylindrical body being extended to the extent that its free end overlaps with a part of the inner circumferential surface of said plunger when said plunger is at the fully retracted position.

2. The coaxial type starter device according to claim 1, wherein said cylindrical body is provided with cut portions at positions corresponding to said windows formed in the rear bracket so that the cylindrical body does not interfere with said stationary contacts.

3. The coaxial type starter device according to claim 1, wherein the axial line of said cylindrical body is common to that of an opening formed in said rear bracket, and an annular body is formed integrally with said rear bracket around said opening so as to extend in the opposite direction to said cylindrical body whereby an end of said armature rotary shaft is rotatably supported through a bearing.

4. A coaxial type starter device wherein a switching contact for actuating a motor is arranged in a space which allows the movement of a plunger in an electromagnetic switch device, characterized in that either the outer circumferential portion of said plunger or the inner circumferential portion of a sleeve to which said plunger fits is provided with a number of grooves extending in its axial direction.

5. The coaxial type starter device according to claim 4, wherein the shape in cross-section of the groove is rectangular.

6. The coaxial type starter device according to claim 4, wherein the shape in cross-section of the groove is triangular 7. The coaxial type starter device according to claim 4, wherein each projection formed between two adjacent grooves has both ends formed in a V-like shape.

8. A coaxial type starter device comprising an armature rotary shaft for a motor, a rotary output shaft with a pinion at its front end which is supported so as to be slidable in its axial direction, and an electromagnetic switch device attached to the rear end of said motor, all being arranged in the same axial line, characterized by a housing disposed between said motor and said electromagnetic switch device so as to support said armature rotary shaft and having insertion holes for receiving brush holding parts, and a brush holder fitted to said housing on the side of said electromagnetic switch device so as to close an opening formed in said housing, said brush holder being provided with said brush holding parts on the side of said motor and stationary contacts on the side of said electromagnetic switch device so that they are engageable with movable contacts disposed in said electromagnetic switch device, wherein said brush holder is provided at a rear side thereof with a cylindrical body (258) which surrounds said movable contacts and has a free end portion which is near an inner circumferential portion of a front end of a skirt portion of a plunger with a small gap in the radial direction of the inner circumferential portion of the plunger.

9. A coaxial type starter device comprising an armature rotary shaft for a motor, a rotary output shaft with a pinion at its front end which is supported so as to be slidable in its axial direction, and an electromagnetic switch device attached to the rear end of said motor, all being arranged in the same axial line, characterized by a housing disposed between said motor and said electromagnetic switch device so as to support said armature rotary shaft and having insertion holes for receiving brush holding parts, and a brush holder fitted to said housing on the side of said electromagnetic switch device so as to close an opening formed in said housing, said brush holder being provided with said brush holding parts on the side of said motor and stationary contact on the side of said electromagnetic switch device so that they are engageable with movable contacts disposed in said electromagnetic switch device, wherein said housing is provided whit a boss-like projection (254*a* ) extending toward said electromagnetic switch device, and said insertion holes are formed in a circumferential wall of the boss-like projection.

10. A coaxial type starter device according to claim 8, further comprising a cup-shaped cover (259) fixed to an inner face of the plunger, within the skirt portion thereof, and displaceable within the cylindrical body upon movement of the plunger.

* * * * *